US010930179B2

(12) United States Patent
Horne et al.

(10) Patent No.: US 10,930,179 B2
(45) Date of Patent: Feb. 23, 2021

(54) LABEL

(71) Applicants: Nicholas Mark Horne, Eastbourne (GB); James Edward Eldridge, Hastings (GB)

(72) Inventors: Nicholas Mark Horne, Eastbourne (GB); James Edward Eldridge, Hastings (GB)

(73) Assignee: Nicholas Mark Horne, Eastbourne (GB)

( * ) Notice: Subject to any disclaimer, the term of this patent is extended or adjusted under 35 U.S.C. 154(b) by 0 days.

(21) Appl. No.: 15/142,572

(22) Filed: Apr. 29, 2016

(65) Prior Publication Data

US 2016/0321961 A1 Nov. 3, 2016

(30) Foreign Application Priority Data

May 1, 2015 (GB) ..... 1507528

(51) Int. Cl.
*G09F 3/10* (2006.01)
*G09F 3/02* (2006.01)

(52) U.S. Cl.
CPC ..... *G09F 3/10* (2013.01); *G09F 3/02* (2013.01); *G09F 2003/025* (2013.01); *G09F 2003/0213* (2013.01); *G09F 2003/0222* (2013.01); *G09F 2003/0241* (2013.01); *G09F 2003/0257* (2013.01)

(58) Field of Classification Search
CPC ..... G09F 2003/0213; G09F 2003/0257
USPC ..... 40/638
See application file for complete search history.

(56) References Cited

U.S. PATENT DOCUMENTS 4,551,373 A * 11/1985 Conlon ..... G09F 3/0288 283/105
6,594,927 B2 * 7/2003 Witkowski ..... G09F 3/0288 40/306
6,616,189 B2 * 9/2003 Raming ..... B42D 15/006 283/81
7,140,135 B2 * 11/2006 Irvine ..... B65D 23/14 283/81
8,304,073 B2 * 11/2012 Davies ..... C09J 7/0296 156/701
2003/0127180 A1 * 7/2003 Williams ..... G09F 3/0288 156/247
2003/0175509 A1 * 9/2003 Franko, Sr. ..... B32B 7/06 428/354
2004/0228996 A1 * 11/2004 Franzo ..... B31D 1/021 428/40.1
2010/0156087 A1 6/2010 Raming

* cited by examiner

*Primary Examiner* — Kristina N Junge
(74) *Attorney, Agent, or Firm* — Crawford Maunu PLLC

(57) ABSTRACT

A label for an article, the label comprising a first region suitable to display information and a second region comprising attachment means, and an area devoid of attachment means. The label is characterised in that the first 5 region is visible when the label is affixed to the article, and the second region is concealed when the label is affixed to the article.

20 Claims, 10 Drawing Sheets

LABEL

The present invention relates to labelling, and in particular labelling for articles in retail environments. More particularly the present invention is concerned with labelling of articles for sale, or sample articles, which are differentiated by aspects such as technical specification, product range, colour, shade, design, and/or reference number.

Retail outlets provide customers and potential customers with the opportunity to review a range of articles, including those with different technical specifications, product range, colour, shade, design, and/or reference number. The expectation, and hope, is that once a selection has been made the retailer will benefit from supplying the chosen article to the customer. Historically retailers compete with similar retailers to provide the best and most economic shopping experience to customers.

Each article is typically labelled in such a way as to allow the retailer to immediately identify it from the others on offer (whether it be from other brands, other product ranges, or merely a particular shade/design of a certain range) so as to be able to accurately provide the customer with the exact article they have chosen. This is not a trivial matter, and the solution is generally to maintain a record of the varieties offered by each manufacturer, and label each article so that in addition to other relevant information, the specific attributes of that article are clearly identified. However, this also allows the potential customer to immediately identify the chosen article by way of the information displayed on the label.

One of the disadvantages of the current method of labelling articles in this way is that customers can benefit from the browsing experience offered by retailers to select a particular article with the desired attributes and then order the article from elsewhere potentially for less, for example from on-line retailers. This practice is called 'showrooming'. While both on-line businesses and conventional retailers have similar overheads in respect of bulk storage, and selection and delivery of goods once ordered, on-line retailers do not have the overheads of conventional retailers in respect of retail outlets. Retail outlets are likely to require a large floor space to display articles and tend to be in busy shopping areas where rents are high, and the additional costs associated with such outlets include rates, services and insurance. In addition conventional retailers sustain the costs of staffing such retail outlets including wages, pensions and any other benefits. Such staff provide the benefit, to the retailer, of assisting customers to buy the articles offered for sale by the retailer, however they provide little further advantage if such sales are not forthcoming. Where sales are impacted due to the practice of showrooming, the future of the retail model, and also the jobs provided by retailers, are in peril.

The present invention is directed to reduce or eliminate this disadvantage.

The present invention is directed to a label for an article, the label comprising a first region suitable to display information, and a second region comprising attachment means and an area devoid of attachment means. The label is characterised in that the first region is visible when the label is affixed to the article and the second region is concealed when the label is affixed to the article.

Preferably the attachment means provides for re-attachable detachment of the label from the article.

Preferably the attachment means is an adhesive.

Preferably the adhesive is pressure activated.

Preferably the adhesive is heat activated.

In addition, the present invention is directed to a label as set out, in combination with a secondary label, wherein the secondary label is adapted to engage with the area devoid of attachment means of the second region of the label.

Preferably the secondary label comprises a first region suitable to display information, and a second region comprising attachment means for affixing the secondary label to the second region of the label.

Preferably the first region suitable to display information of the secondary label is concealed when the label is affixed to the article.

Preferably the first region of the secondary label is visible if the label is at least partially detached from the article.

The present invention is further directed to a method of labelling an article, the method comprising the steps of providing first information to a first region of a label, providing second information and attachment means to a second region of the label, and attaching the label to the article by the attachment means such that the first information is visible and the second information is not.

Preferably the attachment means provides for re-attachable detachment.

Preferably the attachment means is an adhesive.

Preferably the adhesive is a pressure activated adhesive or a heat activated adhesive.

Preferably the second region comprises an area devoid of attachment means.

Preferably the method further comprises providing a secondary label to engage with the area devoid of attachment means of the second region of the label.

Preferably the secondary label comprises a first region suitable to display information, and a second part comprising attachment means for attaching the secondary label to the area devoid of attachment means of the second region of the label.

Preferably, upon attachment to an article, the first information is displayed and the second information is concealed, and upon at least partially detaching the label the second information is exposed.

DESCRIPTION OF THE FIGURES

Embodiments are described by way of examples only, with reference to the accompanying drawings wherein.

DESCRIPTION

Aspects of the present disclosure are believed to be applicable to a variety of different types of apparatuses, systems and methods involving labels. In certain implementations, aspects of the present disclosure have been shown to be beneficial when used in the context of labelling articles for a retail environment. While not necessarily so limited, various aspects may be appreciated through a discussion of examples using such exemplary contexts.

One class of articles that are purchased at least partly on the basis of specific attributes comprises floor coverings, and their specific attributes include colour, shade and/or design, and they may be identified by a unique product reference number.

Carpets provide one type of floor covering and many types of carpet are available for consumers to purchase. Carpets range from relatively low cost, low specification products to high cost, high specification products the manufacture of which is based on many years of development and experience in the carpet making industry. Brand recognition can be a motivating factor in many sales as customers recognise the value provided by experienced and reputable carpet manufacturers.

A carpet retailer may have a range of products that extend into the tens of thousands, including a variety of manufacturers, manufacturing methods, fabrics and weaves. Information in respect of the manufacturer, construction type, composition, width availability and tog rating comprises the technical specification for the carpet, and it is usual for this information to be on display in relation to a carpet for a customer to make an informed choice, and to confirm to them that the particular carpet delivered to them reflects the technical specification they ordered and paid for. This information is generally displayed on a label attached to the carpet.

Conventionally such a label is also used by the manufacturer and retailer to include further information not relevant to the technical specification, for example information relating to the specific attributes of the carpet which may include the colour, shade, and/or design. This further information is relied upon in terms of logistics, for ordering, delivering, and displaying carpets, and is also relied upon by the retailer to ensure that once a particular carpet, of a particular colour, shade and/or design has been selected by a customer, the correct article can be ordered from the manufacturer for receipt in the retail outlet and delivery to the customer.

Conventional labels have a first side including information for display to any observer, and a second side including an adhesive layer to assist in attachment of the label to the carpet, preferably on the underside. Such adhesive layers can be pressure activated or heat activated adhesives, or may be activated in any other suitable manner.

Figure 1A:
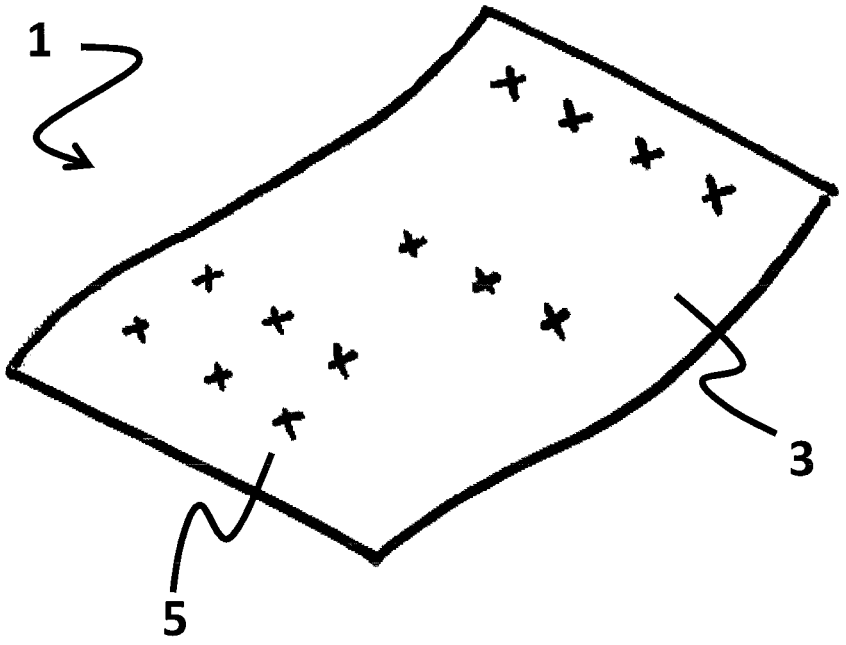
FIGS. 1 (*a*) and (*b*) show a label with a first and second side.
Figure 1B:
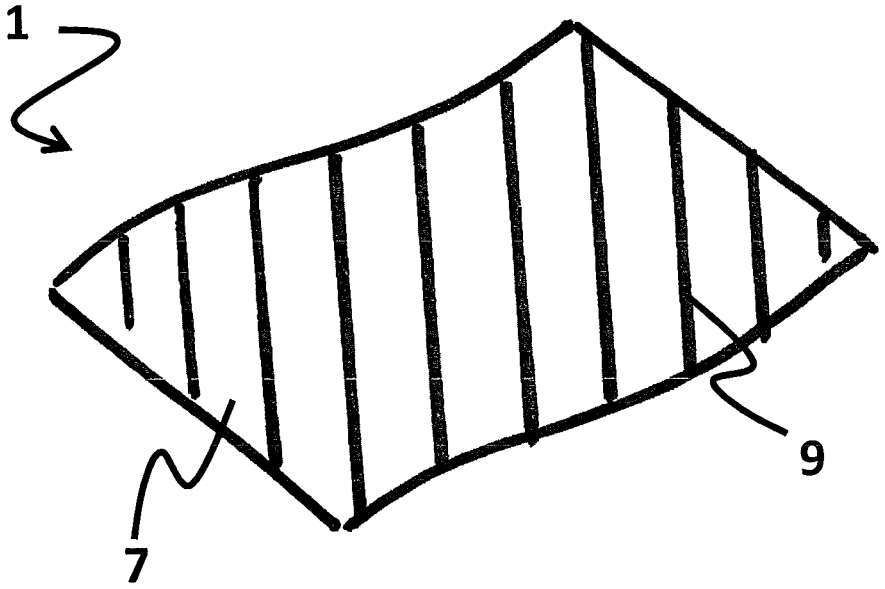

FIGS. 1 (*a*) and (*b*) show respective sides of a conventional label 1. FIG. 1 (*a*) shows a first side 3 of such a conventional label 1, upon which information 5 relating to the broader technical specification is generally placed, in addition to which details relating to the manufacturer or possibly the retailer may be placed for public view. As practiced currently, information identifying further attributes of the particular carpet are also placed on this label in full view. This information might relate to the particular colour, shade, and/or design of the individual carpet and include a unique product reference number. For other products other attributes may be identified. FIG. 1 (*b*) show a second side 7 of the label of FIG. 1 (*a*), which for example includes an adhesive means such as a layer of adhesive 9. Applying the side with the adhesive to an underside of a carpet and assisting with attachment via pressure or heat completes the process of labelling so that the individual carpet includes and displays all the relevant details identifying the carpet.

Returning to FIG. 1 (*a*), the information identifying the further attributes of the particular item, which for a carpet is likely to include the design, colour or shade, is often in the form of a code which the manufacturer can rely on to exactly identify the attributes. By this means an individual article such as a carpet can be uniquely identified for the benefit of the manufacturer and retailer in terms of storing, ordering, displaying and delivering.

It is not essential for a customer to be privy to this information, as it does not affect any of the features of the article that are likely to relate to its cost. For example in the case of a carpet, the manufacturer and other details of the technical specification are essential elements that determine cost and quality, however the colour, shade and/or design relate to the personal choice of the customer and are not likely to be relevant to cost or quality. Once the customer has exercised their choice and advised the retailer of the carpet that is desired, the retailer is responsible for ensuring that the chosen carpet is provided to the customer.

In order to ensure that each carpet is uniquely identified in terms of the colour, shade and/or design so that it may be ordered correctly, it is essential for this specific information to be directly linked with the carpet, and it is logical to place this information on the label together with the rest of the relevant information. However, it would be helpful for retailers if this information were not accessible to the customer.

Access to specific information relating to the colour, shade and/or design of the article is currently restricted through a number of means, including:

Own Branding: this is adopted primarily by larger retail chains, and, for example in the case of carpets in particular, carpet buying groups. It involves replacing the original manufacturer details with own-branded information related to the individual retail chain or, where applicable, carpet buying group. It often misleads the customer into thinking that the product is commissioned by, or manufactured exclusively for, the retailer or buying group concerned. The approach does not stand up to the scrutiny of a determined customer seeking to establish the true identity of the manufacturer and it often leaves the retailer compelled to disclose such information. Own-branding is expensive for the individual retailer to implement and is unconvincing to the customer. Membership commitment to groups, such as carpet buying groups or other groups, is also an expensive option.

Concealment: Simply using a label or permanent marker to cover the information. This is a crude method and leaves the consumer suspicious of the intent of the retailer.

Removal of the label: Simply removing the label on the article for sale is regarded as dishonest and in practice arouses suspicion.

Close supervision of the consumers reviewing the articles: This method involves ensuring the consumers do not take down the unique information whilst browsing the articles for sale. However this method is almost impossible to implement.

Inaccessible: Mounting or displaying the article in such a way that the information is out of immediate reach is frustrating to the customer.

RFID devices: Implanting/attaching RFID tags to articles is expensive to both implement and maintain.

The present invention seeks to improve upon these presently practiced methods.

The advantage of the label as currently used is that conventionally such labels are provided to the carpet anyway, and have been for many years, and are a useful mechanism to carry information specific to the carpet. In addition, it is relied on heavily by manufacturers and retailers at present, much logistical arrangement being dependent on the single label.

Therefore continuing with the present method, of relying on a single label, is preferred. That being so, such specific information could, potentially, be provided as a detachable portion of the present label; but providing specific information only to detach it at a critical time would impact severely on retailers, and would also have an impact in terms of development of labels and on current methods.

In use a conventional label is attached to a carpet by placing the adhesive side against an underside of the carpet and for example holding a heating device against the label to activate the adhesive, so that it attaches to the carpet. Should the label need to be removed a heating device may be held against the label to deactivate the adhesive, whereupon the label or a portion of the label may be removed from the underside of the carpet at will. The label may be reattached by heating, and so on.

Figure 2A:
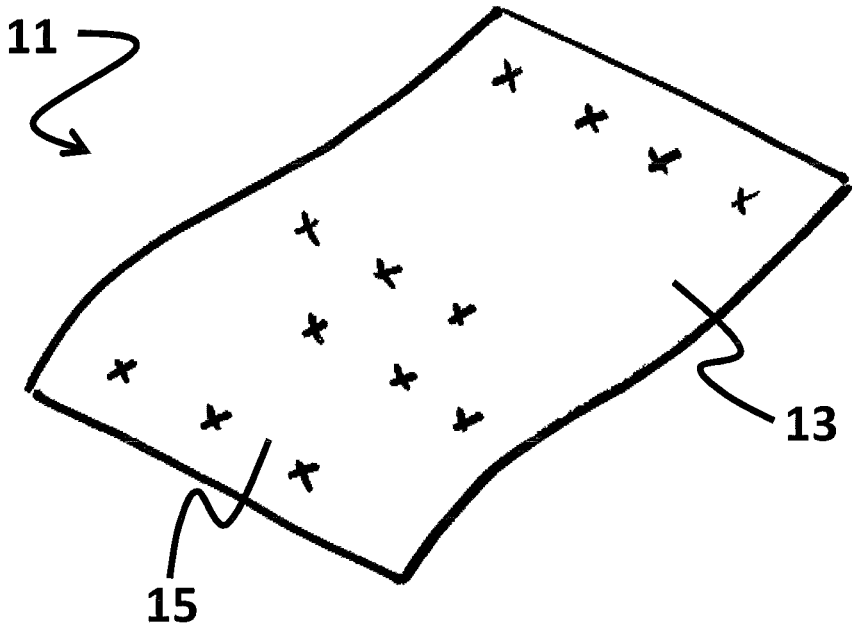
FIGS. 2 (*a*) and (*b*) show a label in accordance with a first embodiment of the present invention.
Figure 2B:
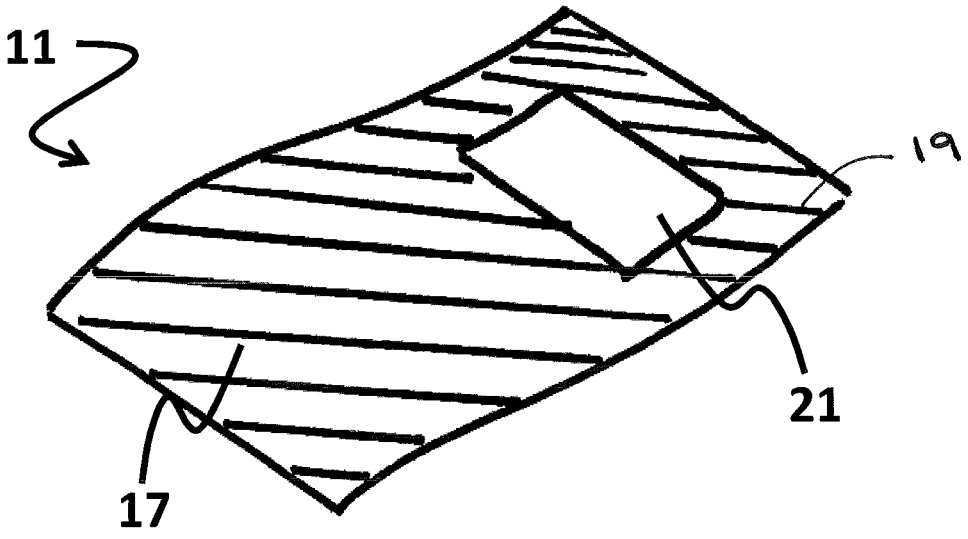

FIGS. 2 (*a*) and (*b*) show a label 11 in accordance with an embodiment of the present invention, showing in FIG. 2 (*a*) a first side 13 including a region 15 suitable for displaying information specific to the carpet, such as the manufacturer and the technical specification, and in FIG. 2(*b*) a second side 17.

The second side 17 includes a region 19 with attachment means such as adhesive, and also includes an area 21 devoid of attachment means, for example in which no adhesive is placed. Information that is specific to the individual carpet, and which is relied upon by the manufacturer and retailer to identify the individual carpet, including such information as the colour, shade and/or design, may be placed on the area 21 devoid of attachment means. Information relating to the manufacturer, retailer, the technical specification and any advertisement for the carpet may be set out on the side of the label that will, with the label in use and attached to a carpet, be visible to the customer. Specific information which identifies for example the particular colours, shades and/or design of the carpet may be placed on the side of the label that will, with the label in use and attached to a carpet, face the carpet, and be concealed from view. De-activating the label adhesive by heating will allow the label to be unpeeled from the carpet to reveal the previously concealed information, allowing the retailer to complete any order form once a purchase has been made. The label may be reattached by reactivating the adhesive by for example heating if the adhesive is a heat activated adhesive.

All information required by the manufacturer and retailer is therefore available on the single label.

There is no indication to the customer that further information is provided on the label in a position not accessible to the customer, and in the event that the customer does became aware it is unlikely that the opportunity to easily heat a label to remove it to view the information will be available. Thus, all the information the customer needs to make an informed decision is available on the label, and all the information needed by the manufacturer is also on the label and accessible by a straightforward mechanism.

This method may work but suffers from the disadvantage that an individual label would still contain information specific to the colour, shade and/or design of a particular carpet and so would need to be placed on the appropriate carpet.

Carpet manufacturers generally provide a master label for each range, but have been known to "de-brand" the labels before they leave the factory. It is desirable that such a master label may continue to be used, and including carpet identifying information on the reverse side of a label would complicate this process.

FIG. 2 (*b*) shows the second side of the label 11 with adhesive layer 19 including an area 21 on which no adhesive is placed. It is contemplated that the adhesive present in layer 19 will be sufficient and effective to attach the label to the carpet. In addition it is contemplated that the label will present a smooth surface to the observer, so that there is no indication that the second side includes a blank portion with no adhesive.

The adhesive free region is shown to be surrounded on all sides by the adhesive region, however it is contemplated that the adhesive free region may be positioned anywhere, including in an area bordering an edge of the label.

While information that is specific to the individual carpet may be placed directly on this adhesive free region, an alternative method is to attach a secondary label in the adhesive free region, this secondary label including information specific to the individual carpet. This method will allow a master label to be produced for each range of carpets sold which can be modified by attachment of the further, secondary, label, to identify individual members of that range, distinguished for example by the colour, shade and design of that individual carpet.

Identification might be achieved through a unique product code for example. The secondary label may be specifically designed to fit in the adhesive free region 21 of the primary "master" label 11. The secondary label may either be opaque, and display the concealed information on itself, or be transparent, and protect the information printed directly onto the back of the primary label beneath it, whilst maintaining visibility of the information through the transparent secondary label.

It is contemplated that the secondary label is adapted to fill the void left by the absence of adhesive on the label, and will be tailor made to make up the differential thickness.

Figure 3:
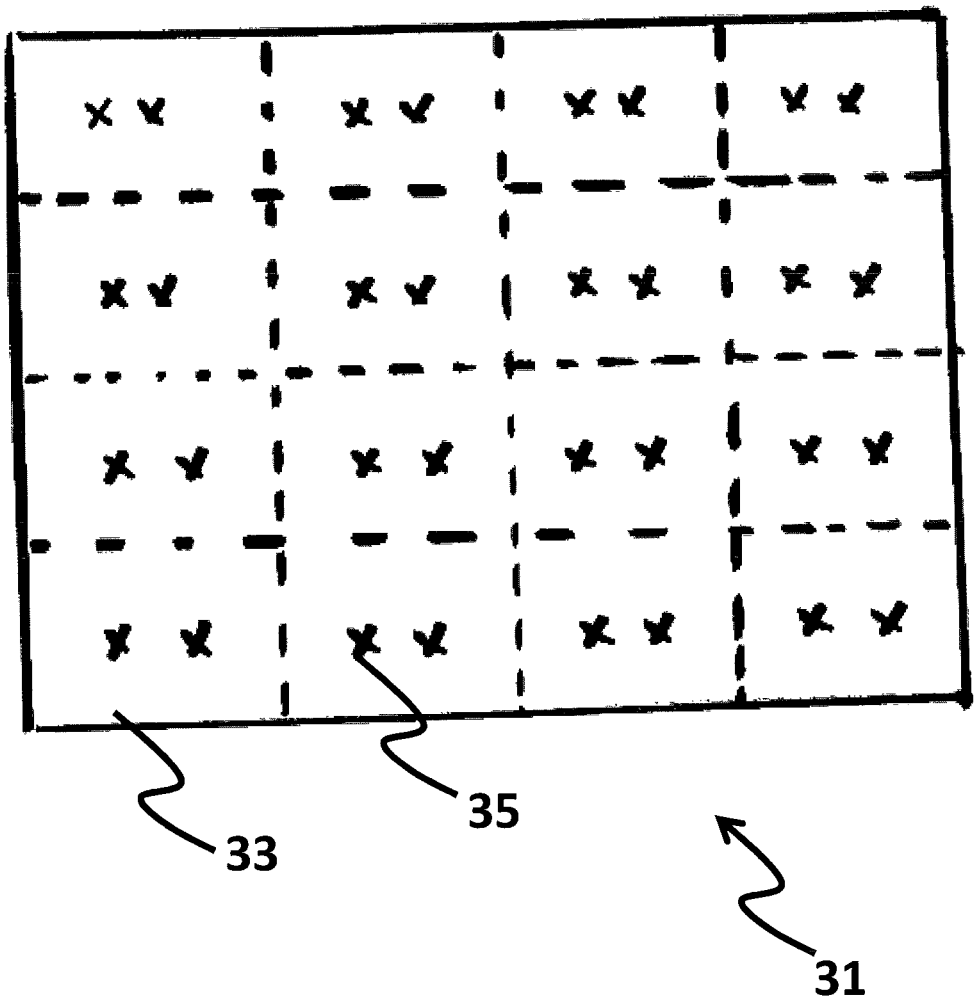
FIG. 3 shows a means to store an item in relation to the present invention, FIGS. 4 (*a*) and (*b*) show a detail of the feature of FIG. 3.
Figure 4A:
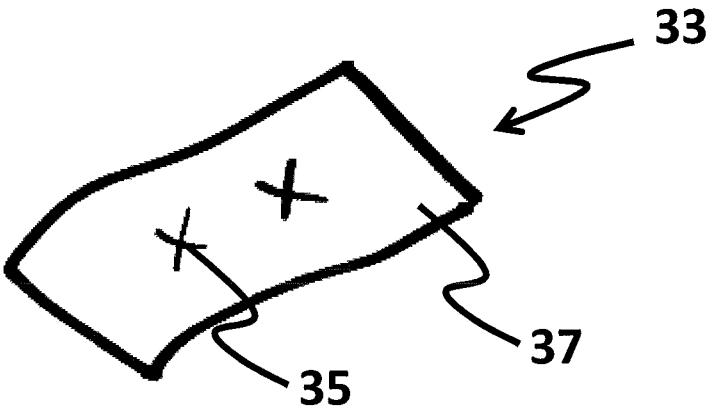
Figure 4B:
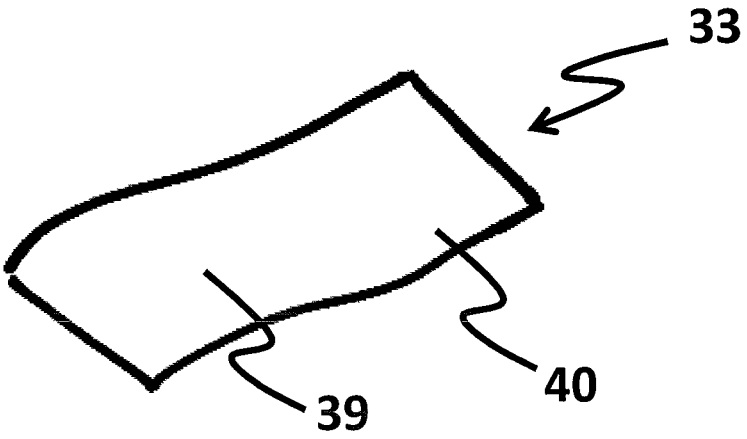

FIG. 3 shows a conventional sheet 31 containing a multiplicity of secondary labels 33: these secondary labels are conventional and may be peeled off the sheet individually for re-attachment elsewhere, for example on the adhesive free region 21 of a master label 11. An example of one of these secondary labels is shown in FIGS. 4 (*a*) and (*b*). The secondary labels include a first side 37 on which information 35 can be provided, and a second side 39 containing an adhesive layer 40 which provides for attaching the secondary label as required. The secondary label 33 can be provided with specific information relating to the colour, shade and/or design of a carpet, and can then be peeled of the sheet 31 on which it is mounted for placement on the adhesive free region 21 of the master label 11, just before for example the master label is to be placed on an appropriate carpet. Alternatively information can be provided on the second, adhesive carrying side of the secondary label to safeguard the information from damage that might result from for example residual traces of adhesive left on the article by a previous label, or some other cause.

Figure 5:
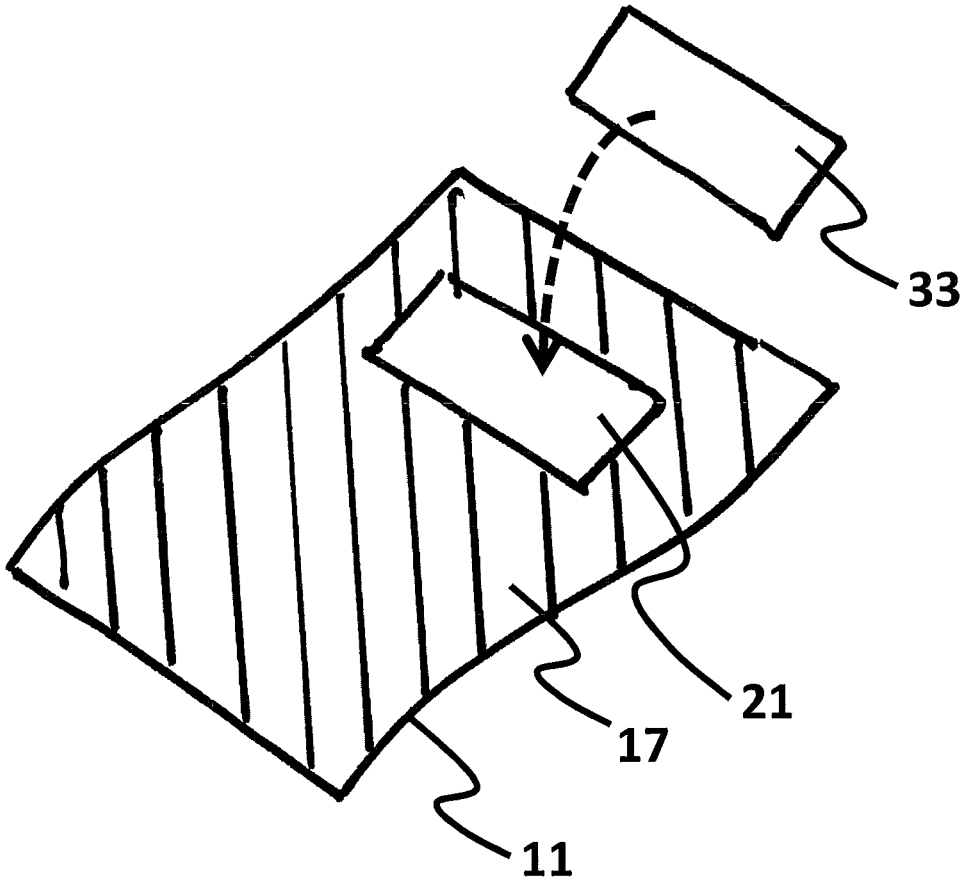
FIG. 5 shows an aspect of the first embodiment.

FIG. 5 relates to this process and shows the second side 17 of a master label 11, with the adhesive free portion 21, available to receive the secondary label 33.

The master label has thus been adapted such that in use, when attached to a carpet, information relative to the technical specification of the carpet is visible, and further information, specific to the carpet on which it is to be placed, is concealed. A customer viewing the carpet in a retail establishment will have access to the technical specification and provenance of the carpet, so that an informed choice may be made regarding the quality and material of the carpet to be purchased. Information specific to the carpet, including the colour, shade and design, which the customer has had the opportunity to review in the retail establishment, is not readily accessible to the customer, but is still available to the retailer so that if a choice is made the correct carpet may be ordered and provided to the client, and the logistics of so doing are not compromised. In use, a batch of master labels 11 are provided which include the technical specification of the carpet, and also any required information regarding the manufacturer or retailer that may desirably be shown to any potential customers. In addition a batch of secondary labels are provided, containing information specific to the colour, shade, and design of members of a particular range of carpets, this information to be concealed.

At a time before displaying the article, a secondary label may be placed on a master label, and the modified master label may then be placed on a relevant carpet by activating the adhesive, for example by heating the label, and applying the label to the underside of the carpet. Each carpet thus has a label including technical and other information on display on the label on the underside of the carpet.

Carpets labelled in this way are available to be placed on display for shoppers to browse. Once a shopper selects a carpet to purchase the retailer may unpeel the label, for example by heat treating the label, and view the carpet specific information that identifies the particular carpet that has been selected. The retailer can then order the carpet and be confident that the correct carpet, of the correct colour, shade and design has been ordered.

While the customer is browsing and after selection has occurred, the customer has at no time the opportunity to access the carpet specific information that identifies the colour, shade and/or design of the desired carpet. This protects the interests of the retailer and also of the manufacturer and sales staff, as it reduces the opportunity for showrooming.

While the invention has been discussed in terms of floor coverings, and particularly carpets, the label is suitable for many other applications. For example fabric goods such as curtains, household linen, and covers may have labels applied in a similar manner, as, in addition, can articles of clothing or any other articles for sale which have, or would benefit from having, labels attached.

Figure 6:
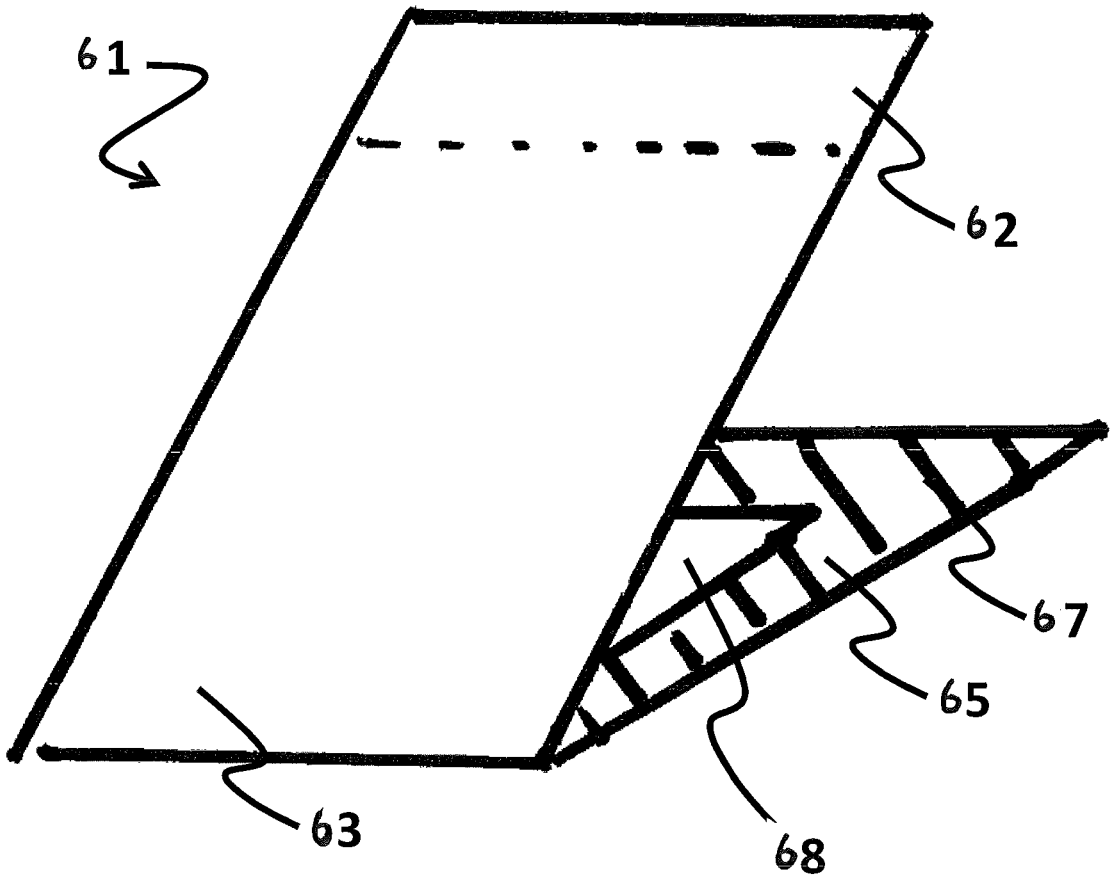
FIG. 6 shows a second embodiment of the present invention.

FIG. 6 shows a label according to a second embodiment of the present invention. In accordance with this embodiment label 61 is designed to be folded over and attached/sealed/adhered to itself. The label 61 comprises two sides; a primary/outer information displaying side 63 visible to the consumer, and a secondary/inner side 65 concealed from view when the label is folded over. The secondary side 65 comprises an area 67 of adhesive, and an area 68 void of adhesive suitable for either displaying information or receiving a secondary label to engage with the area 68 void of adhesive. The label 61 may incorporate an over-lap region 62 which may be used to attach the label to the article. This embodiment may be attached to the article by any means, either directly by adhesive, or indirectly via alternative attachment means such as plastic tag fasteners, or other suitable means.

Figure 7:
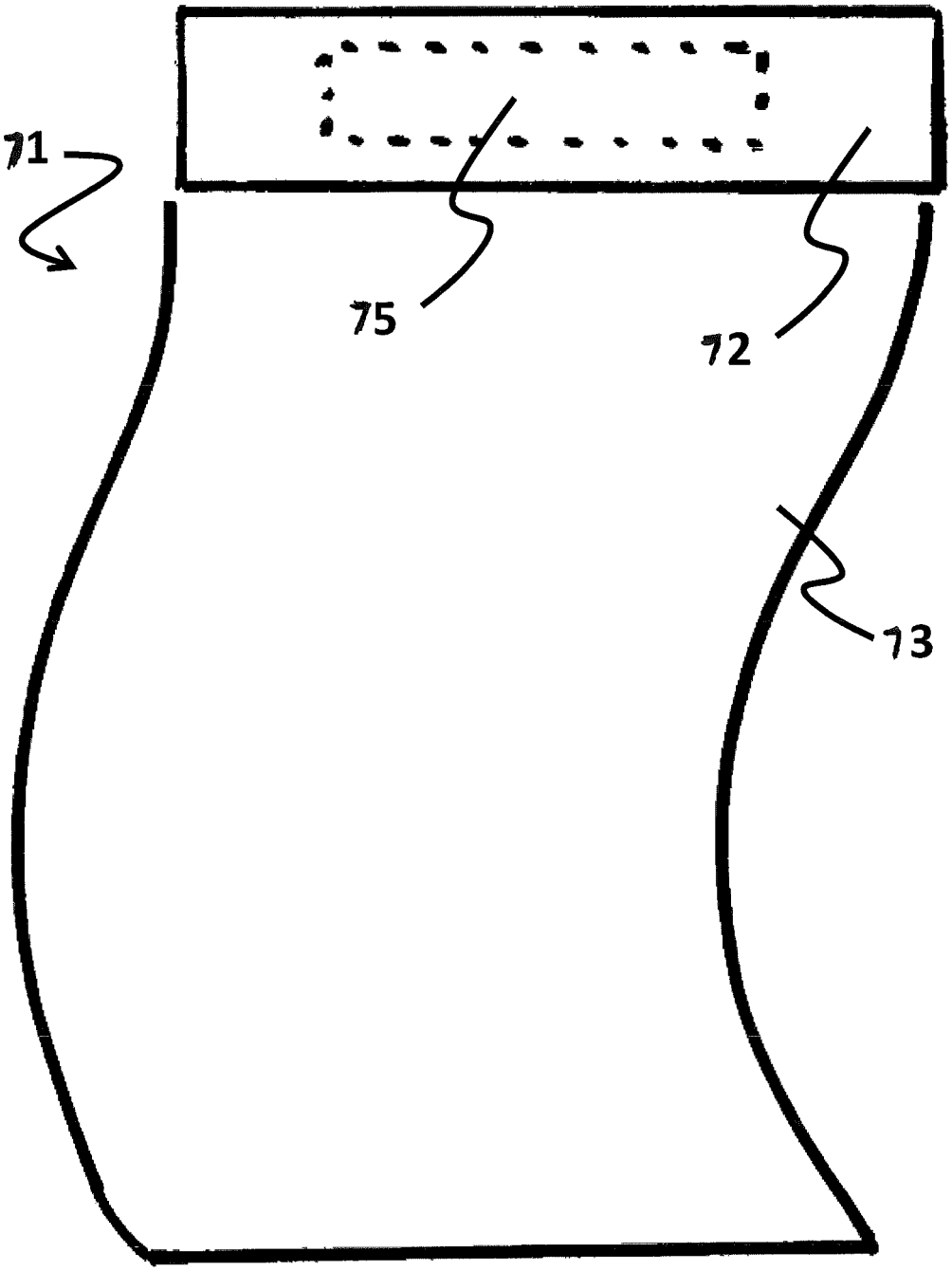
FIG. 7 shows a third embodiment of the present invention, and FIGS. 8 (*a*) to (*c*) show a fourth embodiment of the present invention.

A third embodiment of the invention is shown in FIG. 7. Label 71 incorporates all the features found in the first embodiment, but is comprised of two distinct regions; a first header region 72, and a second swatch region 73. Whilst the header region 72 is attached directly to the article in question in a manner described by the label of the first embodiment, the swatch region 73 is attached only to the header region 72, and is therefore free to move and be viewed (on both sides) by the consumer. The header 72 has an area 75 devoid of adhesive which conceals information displayed on the back of the label between the header 72 and the article upon which it is attached, in the manner previously described.

Figure 8A:
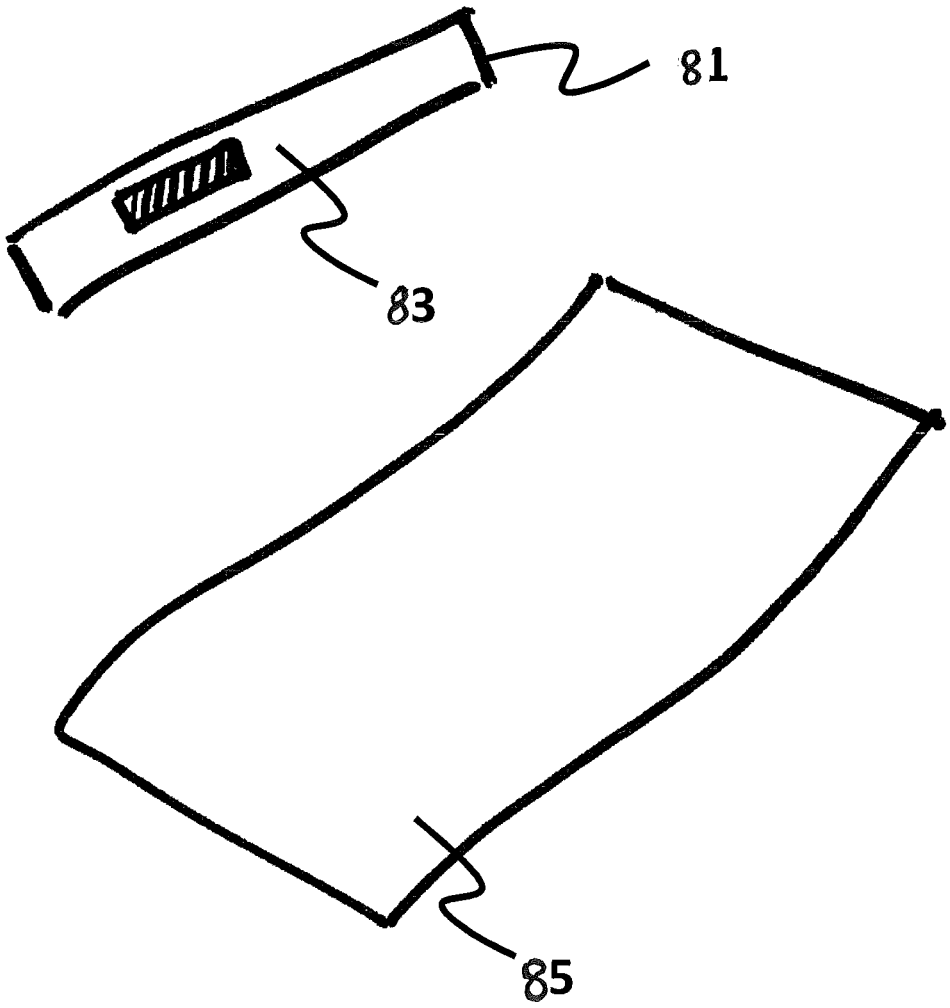
Figure 8B:
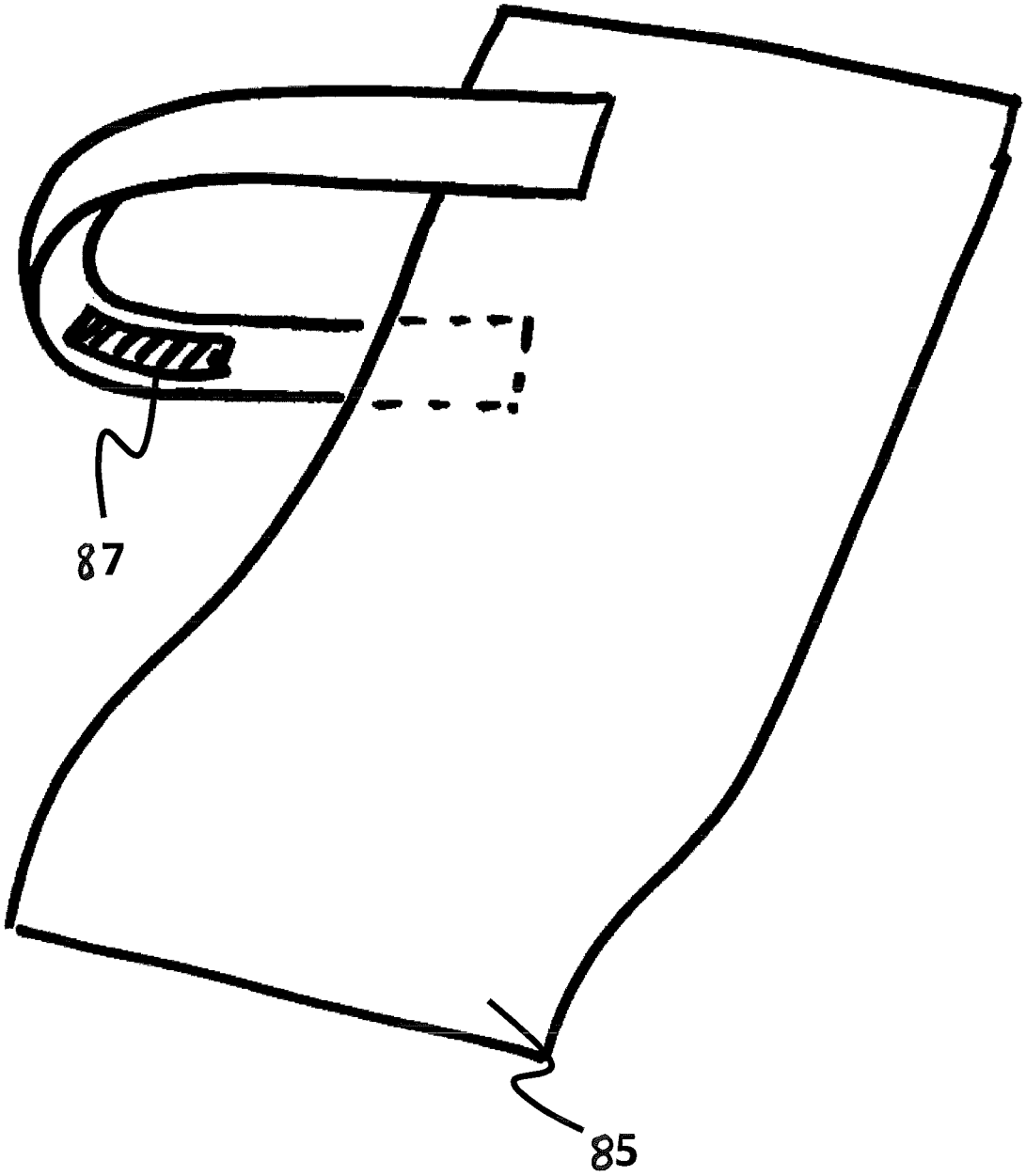
Figure 8C:
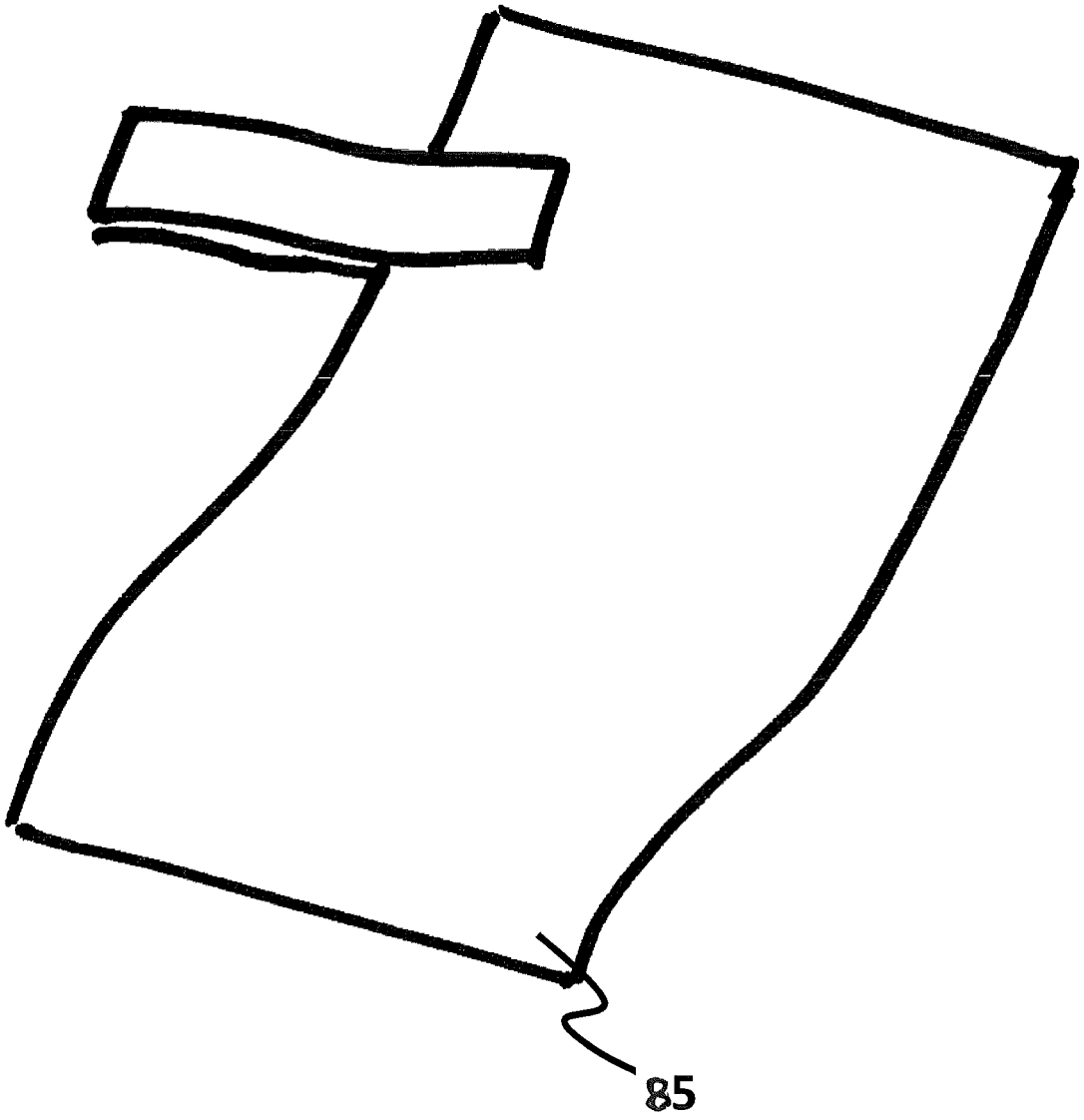

FIGS. 8 (*a*) to 8 (*c*) show a fourth embodiment of the invention in which a label 81 is adapted for attachment to for example a fabric 85. As shown in FIG. 8 (*a*), label 83 comprises an elongate strip, each end of which attaches to the fabric 85 in a conventional manner, such that the label folds back over itself as shown in FIG. 8 (*b*). Information relative to the technical specification of the fabric or item to be sold is visible for the shopper on an outer surface of the label, whereas information 87 specific to the colour, shade or design of the fabric is provided to the inside of the folded label so that it is accessible to the retailer and manufacturer but not easily available to the shopper, as shown in FIG. 8 (*c*).

The invention is suitable for a wide variety of goods, in fact for any goods which are supplied in a variety of colours, shades, or designs, or any goods which differ in a non-technical manner from others with the same specification, and where the distinguishing features which identify the particular variety are viewed by shoppers so that they can select the particular item that suits them best.

The invention is not limited to the embodiments disclosed herein, but relate to any suitable alternative that falls within the overall scope of the invention.

For example, other attachment means are contemplated to fall within the scope of the invention and attached claims. In addition, other articles and attributes not specifically described are contemplated to fall within the scope of the invention and claims.

What is claimed is:

1. A label for an article, the label comprising:

a first side of the label having a surface with information displayed thereon;

a second side of the label, opposite the first side and including a surface having an area of the surface having attachment means, and an area of the surface devoid of the attachment means and surrounded on all sides by the area of the surface having said attachment means; and a secondary label engaged with the area of the surface that is devoid of attachment means, having a surface that is devoid of attachment means, and being surrounded laterally by the attachment means on the same surface, characterized in that, when the label is affixed to the article via the attachment means that surrounds both the area of the surface that is devoid of the attachment means and the secondary label:

the first side of the label is visible, the surface devoid of the attachment means and the secondary label are disposed between the information displayed on the first side of the label and an underlying surface of the article around which the attachment means is secured, and the area devoid of attachment means and the secondary label are concealed when the label is affixed to the article with at least a portion of the surface of the secondary label devoid of attachment means and the attachment means that surrounds the secondary label being in direct contact with the article, the attachment means being configured and arranged to prevent viewing of the area devoid of attachment means and the secondary label while the attachment means affixes the label to the article.

2. The label according to claim 1, wherein the attachment means provides for re-attachable detachment of the label from the article, therein facilitating viewing of the area devoid of attachment means when the attachment means is separated from the article, and subsequently preventing viewing of the area devoid of attachment means when the attachment means is re-affixed to the article.

3. The label according to claim 2, such that when at least partially detached from the article, said area devoid of attachment means is visible.

4. The label according to claim 1, wherein said attachment means is an adhesive and the first and second sides of the label are configured such that the first side is visible when the second side is adhered to the article with the attachment means directly in contact with the article.

5. The label according to claim 4, wherein said adhesive is responsive to heat and is configured and arranged to prohibit visual access to the area of the surface devoid of the attachment means by securing the label to a surface of the article with an adhesive force sufficient to prohibit removal of the label, and facilitate access to the area of the surface devoid of the attachment means by, when the label is attached to the article, by decreasing the adhesive force in response to heat.

6. The label according to claim 1, wherein the secondary label comprises:

a first region suitable to display information, and a second region comprising attachment means for affixing the secondary label to the-area devoid of attachment means.

7. The label according to claim 6, wherein the first region suitable to display information of the secondary label is concealed when the label is affixed to the article.

8. The label according to claim 6, wherein:

the first region of the secondary label is visible if the label is at least partially detached from the article;

the secondary label is separate from a substrate having the first and second sides of the label; and the secondary label and the adhesive have a common thickness.

9. The label according to claim 1, further characterized in that:

the first side includes a first side region for display of said information, and said attachment means are configured to secure a first portion of the label to a second portion of the label in a folded orientation in which said first side region is visible and the area devoid of attachment means is concealed.

10. The label according to claim 9, wherein said attachment means are configured to secure a first portion of the label to the second portion of the label and a first surface of the article, and to secure a second portion of the label to a second surface of the article in folded orientation in which said first side region is visible and the area devoid of attachment means is concealed, the first and second surfaces of the article being opposing surfaces of a common portion of the article with the article being disposed between the respective portions of the label adhered thereto.

11. A label according to claim 1, wherein the label further comprises a header section for engagement with the article, and a swatch section attached to the header section and free from the article.

12. The label according to claim 1, wherein the first and second sides of the label are opposing surfaces of a material sheet that forms the label.

13. A method of labelling an article, the method comprising the steps of:

providing first information to a first side of a label, providing second information and attachment means to a second side of the label with the attachment means extending around the second information, providing a secondary label engaged with an area devoid of attachment means of the second side of the label and laterally surrounded by the attachment means, the secondary label having a surface area that is devoid of attachment means, and attaching said label to said article by said attachment means, by engaging the attachment means laterally surrounding the area devoid of the attachment means directly to a surface of said article, such that said first information is visible and said second information and the secondary label are disposed between the first information and an underlying surface of the article and are not visible and such that the attachment means and at least a portion of the surface area of the secondary label devoid of attachment means is facing and in contact with the surface of said article to which the attachment means is engaged, and using the attachment means to prevent viewing of the second information while the attachment means is engaged directly to the surface of said article.

14. The method according to claim 13, wherein said attachment means provides for re-attachable detachment by:

prohibiting visual access to the second information by activating an adhesive via an external energy source and therein securing the label to a surface of the article with an adhesive force sufficient to prohibit removal of the label from the article, and facilitate access to the second information by, when the label is attached to the article, deactivating the adhesive via an external energy source and therein reducing the adhesive force necessary to remove the label from the article.

15. The method according to claim 14, wherein said attachment means is an adhesive.

16. The method according to claim 15, wherein said adhesive is a heat activated adhesive.

17. A method according to claim 14, wherein upon attachment to an article, said first information is displayed and said second information is concealed, and upon at least partially detaching said label said second information is exposed.

18. The method according to claim 13, wherein providing the first information to a first side of a label and providing the second information and attachment means to the second side of the label includes providing the first and second information on opposing surfaces of a material sheet that forms the label.

19. The method according to claim 13, wherein said secondary label comprises:

a first region suitable to display information, and a second region comprising attachment means for attaching said secondary label to said area devoid of attachment means of the second side of the label.

20. The method of claim 13, further including:

securing a first portion of the label to a second portion of the label in a folded orientation in which the first information is visible and the second side is not, or providing a label header section for engagement with said article and a swatch section attached to the header section and free from the article.

* * * * *